United States Patent [19]

D'Arca

[11] 4,088,081

[45] May 9, 1978

[54] CARD TRAY

[75] Inventor: Stephen S. D'Arca, Garden Grove, Calif.

[73] Assignee: Alpha Nova Development Corp., Santa Ana, Calif.

[21] Appl. No.: 816,384

[22] Filed: Jul. 18, 1977

[51] Int. Cl.[2] ..... A47B 17/00

[52] U.S. Cl. ..... 108/27; 108/97; 248/226.1

[58] Field of Search ..... 108/27, 90, 97, 98, 108/152; 248/226.1; 211/86

[56] References Cited

U.S. PATENT DOCUMENTS

| | | | |
|---|---|---|---|
| 1,288,560 | 12/1918 | Gordon | 248/226.1 |
| 1,888,649 | 11/1932 | Anderson | 108/27 |
| 2,401,182 | 5/1946 | Paxton et al. | 108/97 X |
| 2,935,209 | 5/1960 | Fritz | 108/97 X |
| 3,008,679 | 11/1961 | Powell | 248/226.1 |

FOREIGN PATENT DOCUMENTS

| | | | |
|---|---|---|---|
| 73,655 | 4/1930 | Sweden | 248/226.1 |

*Primary Examiner*—James T. McCall
*Assistant Examiner*—Peter A. Aschenbrenner
*Attorney, Agent, or Firm*—William C. Babcock

[57] ABSTRACT

A universally attachable tray assembly adapted to be secured to table edges of various configurations including on the surface thereof a set of instructions regarding a particular card game, chip recesses for storing betting chips and a drink recess. The underside of the tray is provided with an orthogonal mounting surface arranged as a rectangular strip extending transversely across the tray bottom, the rectangular strip including a plurality of vertical slots formed therein for receiving securing fixtures. The vertical slots are separated by a dimension equal to the dimension separating a plurality of screw holes and slots formed in the surfaces of an angulated mounting bracket which may thus be secured in any angular arrangement to adapt to the edge configuration of the table. Included furthermore in the mounting bracket and offset from the screw holes therein are two spacer blocks, once more including the requisite fastener openings, the spacer block providing the desired separation of the mounting bracket to adapt to their regular edge shapes. In this manner the mounting bracket may be attached to the tray by wing nuts or similar attaching devices in any of its many attaching modes to conform to the various edge shapes normally found in card tables.

5 Claims, 6 Drawing Figures

CARD TRAY

BACKGROUND OF THE INVENTION

1. Field of the Invention

The present invention relates to card trays, and more particularly to game organizing trays attachable to various card tables.

2. Description of the Prior Art

Any game of cards, when first played, requires all the concentrative powers of the player in order to be carried out successfully. In particular, the game of poker requires knowledge of elaborate rules detailed observation of the other hands played, and in particular, detailed observation of the betting as it proceeds around the table. Thus a novice is quickly overwhelmed by the number of tasks before him, and without a convenient means for organizing his game, quickly becomes a loser at the table. For this reason, the prior art included many varying card playing aids, some in the form of odds predictors and some others assisting the player in organizing his betting chips. Further prior art devices provided the inscriptions necessary to refresh the rules to the player. In each instance these prior art devices are rarely combined in a single unit and even where combined are not adapted to conveniently attach to the table structure on which cards are played. Thus, most often the poker tray is placed on the top of the table or along the edge thereof, very little assistance being provided the player in manipulating the cards to obtain a successful arrangement.

Where card trays have been developed for table attachment, such most frequently was achieved by way of spring clips. This attachment fixture is often distracting, since the player, by varying the loads imposed can easily disrupt the arrangement. The previous spring clip arrangements, furthermore, are not totally adapted for the various table edges, and therefore, have had less than a prevailing acceptance in the marketplace.

SUMMARY OF THE INVENTION

Accordingly, it is an object of the invention to provide a card tray which is universally securable to various card tables.

Other objects of the invention are to provide a card tray which in its combined form includes provisions for displaying the rules of the card game, provides storage space for the betting chips and conveniently locates the various cards in the hand of the player.

Additional objects of the invention are to provide a card tray which is conveniently adaptable to the table and which furthermore allows for convenient transfer of the card from the table surface onto the surface thereof.

Briefly, these and other objects are objects of the present invention by providing a card tray substantially rectangular in plan form, the card tray including a raised edge around three sides of the periphery thereof and a tapered ramp on the fourth edge across which the cards placed on the table can be translated. Formed on the underside of the card tray and extending substantially transverse thereto is a rectangular, orthogonally aligned, mounting strip conformed to include a plurality of slots and recesses as required hereinbelow. An angular mounting bracket is attachable to this mounting strip by way of attachment fixtures of the thumb screw type, these fixtures being passed either through slots formed on one surface of the mounting bracket or through various attachment bores in the other surface thereof. In addition, the mounting bracket includes spacer blocks along the other surface through which separation can be achieved between the mounting strip and the bracket. It is this separation that allows for the retention of irregularly shaped edges in the card table.

It is contemplated to further provide in the face of the tray an instruction area wherein game rules may be inscribed assisting the player. Furthermore, the same tray may include semi-circular recesses for storing chips of various denominations and a cup holder or ashtray to free the hands of the player.

DESCRIPTION OF THE SPECIFIC EMBODIMENT

Figure 1:
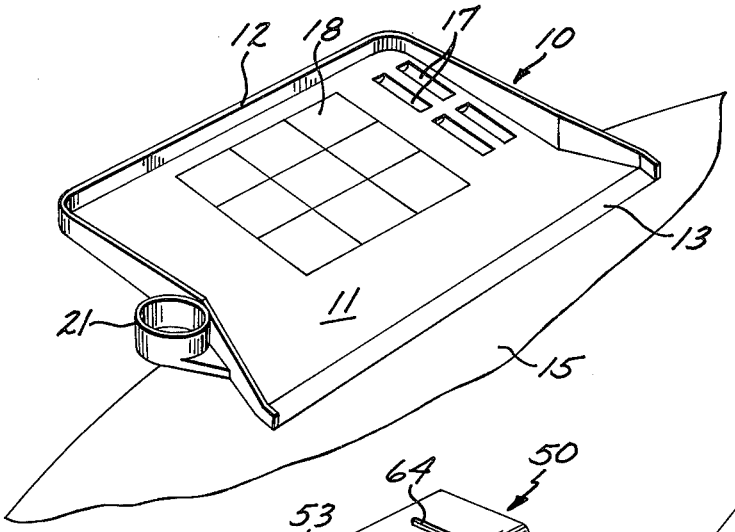
FIG. 1 is a perspective illustration of a card tray constructed according to the present invention.
Figure 2:
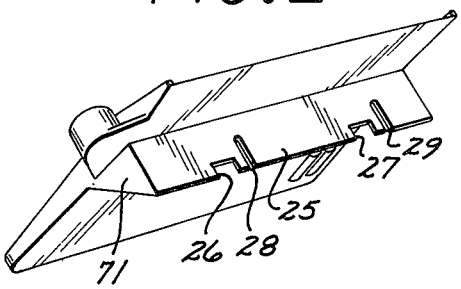
FIG. 2 is a perspective illustration of the underside of the card tray shown in FIG. 1.
Figure 3:
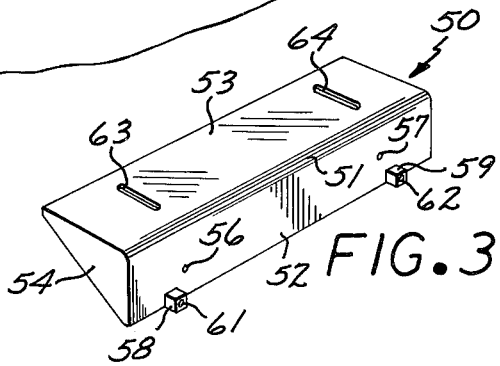
FIG. 3 is a perspective illustration of a bracket useful with the card tray shown in FIG. 2.

As shown in FIGS. 1, 2 and 3, a card tray, generally designated by the numeral 10, comprises a rectangular surface 11 bounded on three sides by a vertical edge strip 12 and chamfered on the fourth side along a chamfer 13 towards the playing surface of a table 15. Formed in surface 11 are a plurality of semi-circular recesses 17 dimensioned to receive stacks of chips (not shown) according to their denomination.

Also included on the surface 11 is an inscription area 18 having inscribed thereon various rules of the game. As set out herein, it is contemplated that the inscription area 18 includes the various hands possible in poker and while divided for that purpose, any other rules of card playing may be set forth.

Formed adjacent the edge strip 12 and disposed externally to the surface 11 is a circular cup-holder 21 which may also serve the alternative function of an ashtray. In this arrangement, the tray 10 provides all of the frequently used features attendant in playing of cards, assisting in the organizing the game which is of particular significance to a novice who is already burdened with the many other complexities.

This tray configuration is attachable to the edge of the table 15 by way of a vertical attachment strip 25 disposed on the underside of surface 11, aligned transversely across the tray in a plane substantially parallel to the open edge. The free edge of the vertical attachment strip 25 is provided with two cut-outs 26 and 27 of rectangular planform, cut-outs 26 and 27 being offset relative to similarly spaced elongate slots 28 and 29. Cut-outs 26 and 27 and slots 28 and 29 are utilized alternatively to attach a bracket generally designated by the numeral 50 to the tray assembly 10.

More specifically bracket 50 includes an L-shaped surface 51 comprising two surface flats 52 and 53 joined on an orthogonal angle and reinforced at either end by a triangulating web 54. Formed in the surface of flat 52 are two fastener holes 56 and 57 separated by a dimension equal to the separation between slots 28 and 29 or the rectangular cut-outs 26 and 27. Included furthermore on flat 52 and projecting outwardly therefrom are two rectangular stand-offs 58 and 59, each conformed for receipt within a corresponding cut-out 26 and 27 and each offset from the openings 56 and 57 by an amount equal to the offset between the cutout and slots in strip 25. Stand-offs 58 and 59 furthermore include the necessary fastening bores 61 and 62 to provide the alternative modes of attachment set out below. In a similar manner flat 53 includes two elongate slots 63 and 64, again dimensioned to conform with the dimension separating slats 28 and 29. Thus, either of the holes or openings 56 and 57 or the openings 61 and 62 may be utilized in securing the mounting bracket 50 to the attachment strip 45.

Figure 4:
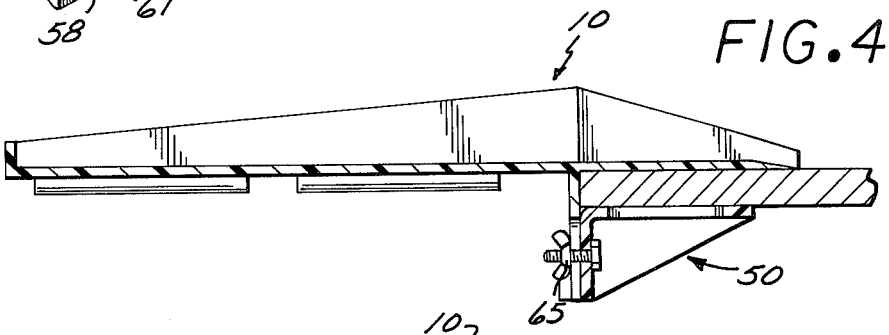
FIG. 4 is a side view, in section, of the card tray shown in FIG. 1.
Figure 5:
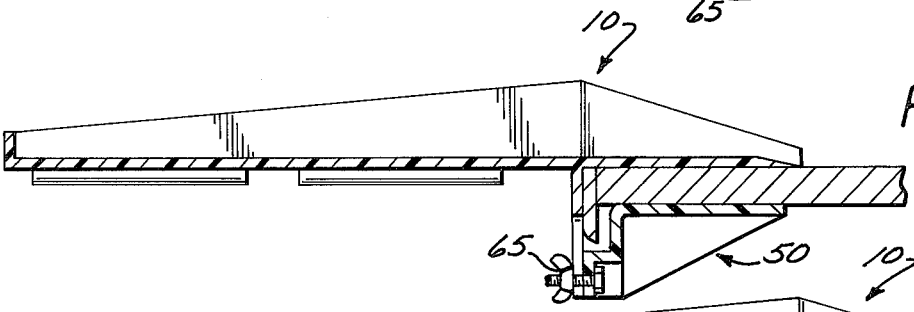
FIG. 5 is a side view, in section, of the card tray illustrating a second mode of attachment thereof.
Figure 6:
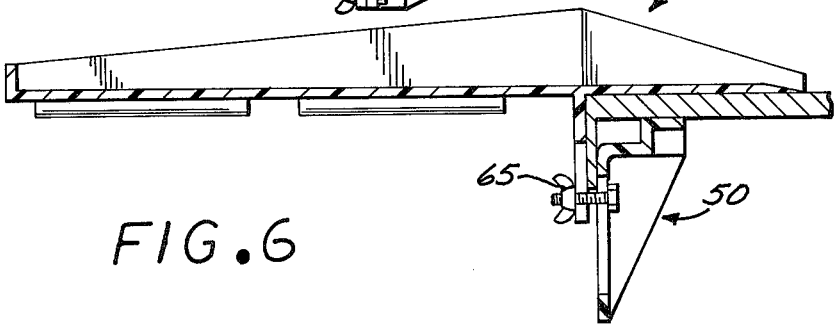
FIG. 6 is once again a side view of the inventive card tray illustrating yet another mode of attachment thereof.

Alternatively, the slots 63 and 64 may be utilized for the same purpose. More specifically, as shown in FIGS. 4, 5 and 6 these various attachment fixtures allow for a great degree of flexibility in accommodating table surfaces of various configurations. As shown in FIG. 4, for example, the attachment of the bracket 50 to the strip 25 is achieved by way of the insertion of a wing nut 65 may be inserted through the bores 61 or 62 and the rectangular stand-offs, the wing nut once more being received within the corresponding slots 28 and 29.

In a further alternative, as shown in FIG. 6, it is possible to insert the wing nut assembly 65 through the slots 63 or 64 and in turn pass the same wing nut assembly through the corresponding slots 28 and 29. Thus, the bracket attachment to strip 25 takes on three alternative forms, in the first alternative the provisions being made to adapt to a flat table structure while in the second alternative accommodation is made to provide a cavity for receiving a compound edge strip in the table. Where the table terminates and a flat thin-walled vertical strip, as shown in FIG. 6, the third alternative may be utilized, the provisions in slot 63 and 64 insuring ample accommodations to the various width of the table edge.

It is contemplated to use plastic material structure to achieve the features set out herein and to provide the necessary triangulating surfaces enhancing the strength thereof. More specifically, it is possible to extend the lateral edge strip 12 on the underside of the surface 11 to form a triangulating membrane 71 for supporting the vertical strip 25. Similarly, the upper geometry of the edge strip 12 may be geometrically controlled to provide the highest bending section at the point of juncture of the tray with the table 15.

Obviously, many modifications and variations to the above disclosure can be made without departing from the spirit of the invention. It is therefore intended that the scope of the invention be determined solely on the claims appended hereto.

What is claimed is:

1. A tray assembly adapted to attach to the edge of a table, comprising:

a tray substantially parallel in planform including a bottom surface bounded along three edges by a peripheral edge strip and having a fourth edge chamfered to a taper;

an attachment strip formed on the underside of said bottom surface and extending normally therefrom, said attachment strip including a plurality of mounting slots extending partly thereacross and a corresponding plurality of cutouts equally offset from said mounting slots;

an attachment bracket formed in the manner of a first and second orthogonal flats joined in common along one edge said first flat including a plurality of attachment slots spaced in lateral separation to align with said mounting slots, said second flat including a plurality of stand-offs conformed for receipt in said cutouts, each said stand-off including a central bore aligned for mating with the said mounting slots, and a plurality of mounting holes, offset from said stand-offs to align with said mounting slots when said stand-offs are received in said cutouts; and a plurality of attachment means alternatively secured in the common interior of said central bores, mounting holes and attachment slots and said mounting slots.

2. Apparatus according to claim 1 further comprising:

a plurality of cylindrical surface depressions formed in the top of said bottom surface; and a circular depression formed along the exterior of said edge strip in substantially coplanar alignment with said bottom surface.

3. Apparatus according to claim 2 wherein said attachment means each comprise a wing nut threadably engageable to a bolt.

4. Apparatus according to claim 3 wherein said tray and said bracket are formed of a plastic material.

5. Apparatus according to claim 4 wherein said attachment strip is aligned substantially parallel to said fourth edge.

* * * * *